United States Patent [19]

DiVito et al.

[11] 4,234,980

[45] Nov. 25, 1980

[54] APPARATUS FOR SEWER CLEANING AND THE LIKE

[75] Inventors: Angelo DiVito, South Euclid; Benjamin P. Fisco, Jr., Shaker Heights, both of Ohio

[73] Assignee: Aquatech, Inc., Cleveland, Ohio

[21] Appl. No.: 39,735

[22] Filed: May 16, 1979

[51] Int. Cl.[3] ..... B08B 3/02

[52] U.S. Cl. ..... 15/302; 15/315; 15/340; 15/353; 134/168 C

[58] Field of Search ..... 15/302, 314, 320, 321, 15/315, 340, 352; 134/167 C, 168 R, 168 C

[56] References Cited

U.S. PATENT DOCUMENTS

| | | | |
|---|---|---|---|
| 2,735,122 | 2/1956 | Pletcher | 15/314 X |
| 3,011,206 | 12/1961 | Breither | 15/320 |
| 3,267,509 | 8/1966 | Boyd | 15/314 |
| 3,600,225 | 8/1971 | Parmelee | 134/168 C X |
| 3,658,589 | 4/1972 | Shaddock | 134/168 C X |
| 4,134,174 | 1/1979 | Flynn et al. | 15/302 |

*Primary Examiner*—Christopher K. Moore

*Attorney, Agent, or Firm*—Pearne, Gordon, Sessions, McCoy & Granger

[57] ABSTRACT

Apparatus is disclosed for cleaning a sewer or other chamber. The apparatus includes a wheeled vehicle having a frame. A water reservoir tank is mounted near the front of the vehicle frame and is adapted to hold a supply of water. A hose unit is mounted at the rear of the vehicle frame. The hose unit has a hose connected to the water reservoir tank and adapted to be inserted into the chamber to discharge water into the chamber. A debris holding tank is mounted on the vehicle frame between the water reservoir tank and the hose unit. The debris holding tank is adapted to receive and hold debris. A boom is mounted on top of the debris holding tank and adapted to extend rearwardly over the hose unit. The boom has a conduit connected to the debris holding tank and adapted to be lowered into the chamber to be cleaned to transport material from the chamber into the debris holding tank. The location of the debris holding tank amid the water reservoir tank and the hose unit permits the boom to extend over the hose unit and be used in conjunction with the hose paid out from the hose reel. The position of the tanks also permits an even weight distribution on the vehicle frame.

9 Claims, 3 Drawing Figures

APPARATUS FOR SEWER CLEANING AND THE LIKE

BACKGROUND OF THE INVENTION

1. Field of the Invention

This invention relates to the apparatus for cleaning sewer lines, pipe lines, and closed chambers and/or conduits in which water is jetted into the conduits at high pressures and in which a partial vacuum is applied for removal of liquids and solids from the conduits.

2. Description of the Prior Art

It is well known to provide a mobile sewer cleaning unit having a reservoir for a large supply of water, and water-handling components, including a hose reel, a hose normally coiled thereon, and a high pressure pump suitably connected between the reservoir and the hose to deliver water to the hose at high pressure. Such a unit is shown in U.S. Pat. No. 3,570,526, issued to Fisco. A nozzle, which is typically attached to the free end of the hose, reverses the direction of the high pressure water in such a way as to develop a reaction force which pulls the hose into the sewer line from the hose reel. It is also conventional practice to provide a drive means for the pump, including an internal combustion engine, the water handling components and the drive means usually being mounted upon a rear platform of a truck or on the bed of a trailer.

It is also well known to provide sewer cleaning units with means for collecting the debris flushed from the sewer line by the high pressure water system. Such debris collecting means typically include a receptacle or tank for storing debris, a conduit extending from the receptacle, an intake tube at the end of the conduit to be lowered into the sewer or other chamber from which the debris is removed, and means for creating a suction force at the intake tube to suck the debris through the conduit and into the receptacle.

The suction creating means used in sewer cleaning units are generally either air conveyance systems or vacuum systems. Air conveyance systems for picking up debris from the sewer pipes and similar chambers are well known, such as that shown in U.S. Pat. No. 3,568,589, issued to Shaddock. Such units use a large fan or compressor to create an air flow in the conduit, which carries debris to a receiving tank. In contrast to these air conveyance systems, vacuum systems utilize a vacuum pump to create a partial vacuum in a collecting tank. With this vacuum, solid and liquid material in the sewer pipe or chamber is sucked through the conduit into the tank. In general, sewer cleaning units using vacuum systems have advantages over those using air conveyance systems. Air conveyance units use an open exhaust system for their fan or compressor. When the debris tank is overfilled, contaminated water is picked up into the air system and discharged into the atmosphere, polluting the air and damaging any objects which are sprayed. In contrast, vacuum units use a completely sealed system. When the tank becomes completely full, an automatic check valve system may be used to cut off the vacuum pump to prevent discharge of the contaminated material. Furthermore, vacuum units, by reason of the high suction created in the tank, are capable of collecting both liquid and solid material. The air movement created by the air conveyance system is capable of drawing with it solid particulate debris, but it is limited in drawing up large amounts of liquid. If water in the sewer covers the intake tube on an air conveyance unit, it will cut down the suction capability of the unit. On the other hand, vacuum systems are especially adapted to pick up liquids, since the end of the intake should be sealed in order to maintain a vacuum in the system, and this seal is usually accomplished by submerging the end of the intake tube below the water in the sewer chamber.

Heretofore, cleaning of catch basins and flushing of sewer pipes has often required the use of two separate vehicles. A first vehicle with the hose reel mounted on the rear end was positioned at the manhole and a high pressure hose fitted with a jet nozzle was introduced into the sewer. Water from a tank on the vehicle was pumped through the hose at high pressure to drive the hose through the pipe against the water flow. Debris flushed from the sewer pipe was then sucked out of the catch basin by a second vehicle, which comprised a debris holding tank and a conduit which was lowered into the sewer or other chamber from which the debris was removed. This multiple vehicle system duplicated personnel, and the equipment was difficult to handle.

The debris holding tank has sometimes been mounted on a trailer which is attached to the rear of the truck unit which contains the water tank and the hose unit. In operation, the operator positions himself between the trailer and the rear of the truck and operates the hose unit and simultaneously attempts to operate the unit on the trailer. The operation of two separate units on separately mounted vehicles is cumbersome, difficult, and sometimes dangerous. It is also expensive to provide a separate trailer which duplicates many of the elements of the truck-mounted tanks, such as chassis, frame, and power means as well as the hitching and unhitching mechanisms.

It has been proposed to mount the debris holding tank directly on the truck chassis with the water tank. The debris holding tank would thus be mounted in front of the water reservior and hose unit. However, this arrangement presents problems of weight distribution which may require a pair of axles on the rear of the truck chassis to handle the increased weight loads. In addition, if a boom were mounted on top of the debris holding tank, the boom must extend entirely across the water tank and the hose reel unit to the rear of the vehicle, and this presents several problems. An extremely long horizontally extending boom is more likely to clog during operation and is more unstable due to the long cantilever.

SUMMARY OF THE INVENTION

The shortcomings and disadvantages of the prior art are overcome by the sewer cleaning apparatus of the present invention.

It is an object of the present invention to provide an improved apparatus for cleaning sewer lines, pipes, and other conduits and chambers in which a high pressue water system is used to flush the chamber and a vacuum system is used to remove liquids and solids flushed from the chamber by the high pressure water system.

It is another object of this invention to provide a sewer cleaning apparatus in which the water supply tank and the debris holding tank are mounted on a vehicle having a single rear axle, thereby eliminating the need for a separate trailer for the debris holding tank, which must be hitched to the rear of the water and hose unit vehicle and transported thereby.

Another object is to provide a sewer cleaning apparatus in which the debris holding tank is located close enough to the rear of the vehicle to permit a boom mounted on the tank to extend over the water handling components to the rear of the vehicle and be used simultaneously with the hose unit without using an excessively long conduit, which might otherwise result in clogging or a loss of vacuum pressure, and without using an excessively long boom, which would be extremely heavy and unstable due to its long lever arm.

Another object is to provide a sewer cleaning apparatus in which solid debris may be separated from the liquid debris in the debris holding tank and discharged through a separate conduit, thus eliminating the necessity for moving the apparatus to a dumpsite, and increasing the effective tank capacity of the apparatus.

These and other objects are accomplished by the present invention of apparatus for cleaning a chamber, such as a sewer, which comprises a wheeled vehicle having a frame. A water reservoir tank is mounted near the front of the vehicle frame and is adapted to hold a supply of water. A hose is mounted at the rear of the vehicle frame. The hose unit has a hose connected to the water reservoir tank and adapted to be inserted into the chamber to discharge water into the chamber. A debris holding tank is mounted on the vehicle frame between the water reservoir tank and the hose unit. The debris holding tank is adapted to receive and hold debris. A boom is mounted on the top of the debris holding tank and is adapted to extend rearwardly over the hose unit. The boom has a conduit connected to the debris holding tank and adapted to be lowered into the chamber to be cleaned to transport material from the chamber into the debris holding tank.

DETAILED DESCRIPTION OF THE PREFERRED EMBODIMENT

Figure 1:
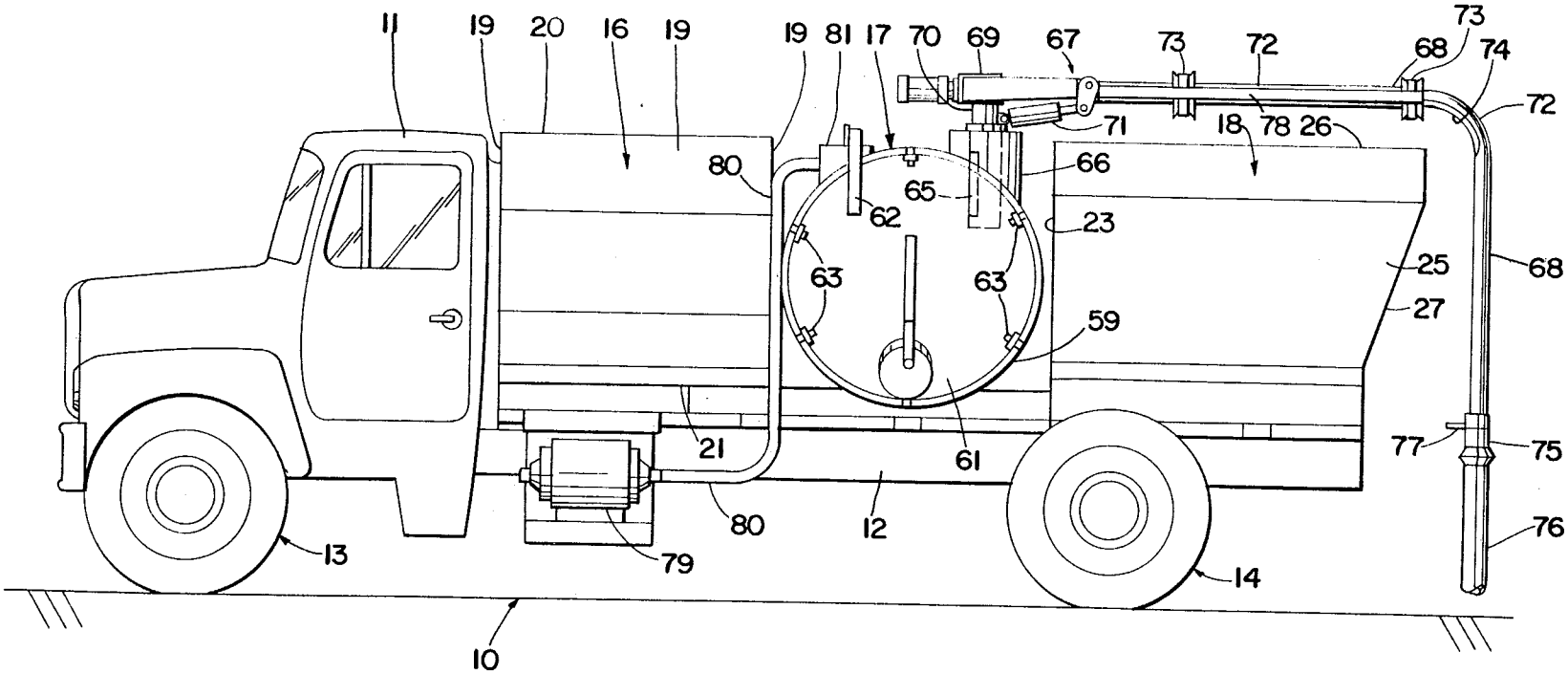
FIG. 1 is a side elevational view of the sewer cleaning unit of the present invention mounted on a truck body.

Referring more particularly to the drawings, FIG. 1 shows the sewer cleaning unit of the present invention. The unit includes a wheeled vehicle, such as a truck 10, or a trailer, railroad car or the like. The truck 10 is of conventional design with a forward driver's cab 11 and a chassis or frame 12 extending rearwardly from the cab. The truck frame 12 may be otherwise conventional and is supported by a front axle wheel unit 13 and a single rear axle wheel unit 14.

On the truck frame 12 are mounted a water reservoir tank 16, a debris holding tank 17, and an assembly unit 18 containing the water handling components. The tank 16 forms a reservoir for the storage of water used for jetting into the sewer or other chamber to be cleaned. The tank 16 is supported on the truck frame 12 immediately behind the cab 11. The water reservoir tank 16 may be generally rectangular in configuration with sides 19, a top 20, and a bottom 21 which is supported on the truck frame 12. The tank 16 may hold from 150 to 1500 gallons of water or more, depending upon the capacity of the apparatus.

Figure 2:
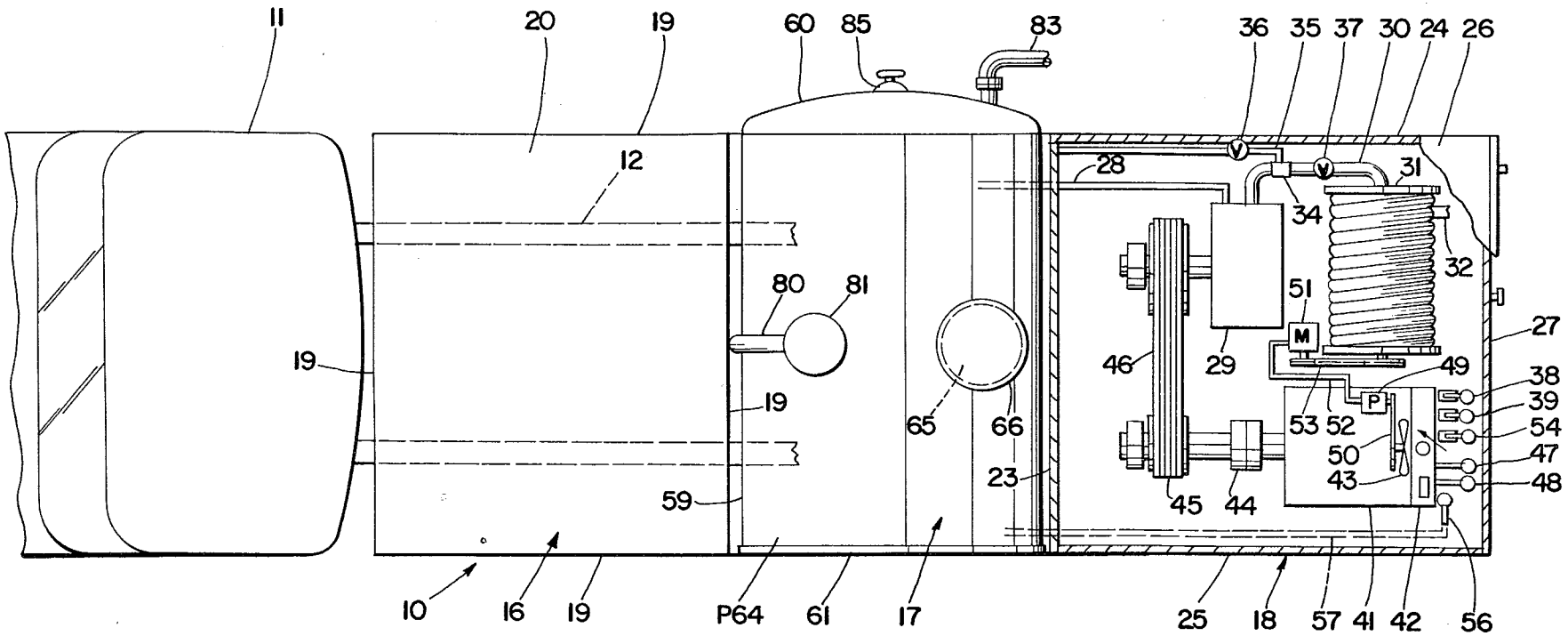
FIG. 2 is a top plan view of the unit of FIG. 1.

The assembly unit 18, which contains the water handling components of the unit, is shown in more detail in FIG. 2. The water handling components are mounted in a housing comprising three closed sides 23, 24 and 25 (FIG. 2), a top 26 (FIG. 1), and a rear panel 27 which may be opened to obtain access to the water handling components and the controls therefor, and which may be closed when the apparatus is not in operation. The components include a water line 28 (FIG. 2) connected to the tank 16. The line 28 extends along the bottom of the apparatus beneath the debris holding tank 17. The water line 28 leads from the tank 16 to a pressure pump 29 (FIG. 2) which may be of a conventional, reciprocating, triplex pump. If desired, a water strainer may be included in the line between the inlet of the pump 29 and the tank 16. A suitable connection 10 leads from the outlet side of the pump 29 to a hose reel 31 mounted to the rear of the pump. The reel 31 is used for storage of a hose 32 which is coiled on the reel. The hose reel 31 may be similar to that disclosed in U.S. Pat. No. 3,476,139. In accordance with known design, the hose 32 may be provided with a self-propelling spray nozzle 33 (FIG. 3) on its leading end which has rearwardly directed outlets, so that the force of the water issuing from the outlets propels the leading end of the hose through a sewer pipe or other conduit. If desired, a conventional rotary root cutting head may also be installed on the leading end of the hose 32. Between the pump 29 and the hose 32 (FIG. 2), the connection 30 is provided with a suitable tee 34 connecting it with a return line 35 which leads back to the water reservoir tank 16, and which supports a bypass valve 36, also connected to the return line 35. In the connection 30, between the return line 35 and the reel 31, is a flow shutoff valve 37, which is similar in construction to the bypass valve 36. Both the bypass valve 36 and the shutoff valve 37 are mechanically connected to control levers 38 and 39 mounted near the rear of the truck.

In operation, the pump 29 produces a high pressure water flow to the hose 32 through the shutoff valve 37 when the shutoff valve is maintained in an open position by means of the lever 39. If the flow of water to the hose 32 is interrupted, the pump 29 can continue to run; the shutoff valve 37 is closed, and the bypass valve 36 is opened by the lever 38 so that the flow of water is recirculated to the tank 16. If desired, the bypass valve 36 and the shutoff valve 37 may be actuated by the same control lever so that as one opens, the other closes.

The means for driving the pump 29 and the hose reel 31 preferably comprises an internal combustion engine 41, which is liquid-cooled, and which includes a radiator 42 cooled by a suitable fan 43 which is driven by the engine 41. Connected to the engine 41 through a regular engine clutch mechanism 44 is a drive wheel 45 and V-belt assembly 46 driving the pump 29. The engine 41 is controlled by levers 47 and 48 which are adjacent to the levers 38 and 39 and which may be operated at the rear of the unit. The payout and retrieval of the hose 32 from the hose reel 31 are powered by a hydraulic assembly which includes a hydraulic pump 49 connected to the engine 41 by a drive belt 50, and a hydraulic motor 51 operatively connected to the pump 49 by a hose 52. The motor 51 is linked to the reel 31 by a chain drive 53. The hydraulic assembly is operated by means of a control lever 54 mounted on the rear of the unit adjacent to the levers 38, 39, 47, and 48.

Instead of providing a separate engine 41, the reel 31 and the pump 29 may be driven by a power take-off from the truck engine located under the hood in the cab 11.

In lieu of the levers 38, 39, 47, 48, and 54, water discharge and reel payout and retrieval may be controlled by means of foot-operated pedal controls which extend rearwardly from the unit and are suitably placed adjacent to the opening to be handled by the operator, as shown in copending U.S. patent application Ser. No. 876,900.

A sight gauge assembly 56, which indicates to the operator the level of the water in the tank 16, is mounted on the side of the unit to the rear of the water handling components. The sight gauge assembly 56 is connected to the tank 16 by a line 57.

If desired, the assembly 18 containing the water handling components may include a shroud assembly such as that shown in U.S. Pat. No. 3,570,526 to Fisco, to keep the water handling components warm and operable during severe winter freezing operating conditions when an internal combustion engine, such as the engine 41, is used as the power source.

Between the water reservoir tank 16 and the water handling components assembly unit 18, a debris holding tank 17 is mounted on the frame 12. The tank 17 provides a receptacle for the storage of sludge, solid, and liquid debris removed from the sewer or other chamber in the cleaning operation. The debris holding tank 17 is generally cylindrical in configuration with an annular wall 59 and dished-form heads 60 and 61 on each side. The dished head 60 is preferably permanently welded on one side of the cylindrical wall 59. The opposite dished head 61 may be openable by means of two hinges 62 which may be mounted at the top of the tank, as shown in FIG. 1, or on the sides of the tank. The head 61 is opened and closed manually or hydraulically and is sealingly clamped to the tank 17 in its closed position by latches 63 so that a partial vacuum may be maintained in the tank.

Instead of an openable head 61 mounted on the tank with the hinges 62, the head 61 may be permanently welded to the side of the tank, and a port or a valve or other means may be provided in the head 61 by which the tank may be opened so the debris may be removed from the tank.

The debris holding tank 17 may be pivotally mounted laterally on the frame 12 by hinge means so that the tank may be raised on one side to a dumping position by a conventional hydraulic hoisting jack. When the debris holding tank 17 is raised to its dumping position, the head 61 may be hydraulically opened to permit debris to be dumped from the tank 17 to the side of the truck.

If the tank 17 is not pivotally mounted on the frame, other conventional methods may be used to clean the tank, such as removal of the debris by a rake or the use of a flushing hose to wash out the tank.

Debris enters the tank 17 through a sealed vertical tube 65 which extends downwardly into the tank through a port 66 and which connects the tank with an outwardly projecting boom 67 (FIG. 1) providing a conduit 68. A manually or hydraulically or pneumatically operated valve is provided at 69 between the top of the vertical tube 65 and the conduit 68 so that the conduit 68 may be closed from the debris holding tank 17. The boom 67 extends from a mast 70 which is pivotally mounted on top of the port 66. In operation of the apparatus, the boom 67 normally extends rearwardly over the water handling components units 18. The boom 67 preferably rotates on the mast 70 up to 360°, and may be tilted so that the outwardly extending end of the boom may be raised or lowered. In accordance with known design, hydraulically powered control means may be provided to raise and lower the outwardly projecting end of the boom 67 and to rotate the boom. Such means would include a cylinder 71 for mounting between the mast 70 and the boom 67 for raising and lowering the boom. The controls for the operation of the boom 67 and the valve 69 are located on the intake valve at the operator's station. The boom 67 may also be operated manually, and it is preferably counterbalanced so that it may be raised and lowered by hand.

The conduit 68 comprises a flexible portion 72 which extends from the mast 70 and which is supported by rings 73 connected to the mast by support members 78. A curved support 74 on the end of the boom 67 extends from the outermost ring 73. The flexible conduit portion 72 extends outwardly, supported by the rings 73 and the support 74, and extends downwardly from the support 74. At the end of the conduit 68 opposite the mast 70, the conduit has a connection 75 for an intake tube 76 (FIG. 3) which is inserted downwardly into the sewer or other chamber to be cleaned. At the connection 75, the conduit is provided with handles 77 which are mounted on the end of the conduit to assist the operator in guiding the tube 76 into the manhole or chamber entrance. The handles 77 may also be provided with control means for operation of the powered movement of the boom 67, whereby the boom may be raised or lowered or rotated, and for other operations as desired.

A partial vacuum is produced in the debris holding tank 17 by means of a vacuum pressure pump 79 (FIG. 1) mounted beneath the water reservoir tank 16 on one side of the truck frame 12. The pump 79 is preferably powered by hydraulic drive unit connected to the hydraulic pump 49 in the unit 18. The pump 79 may also be driven by a power take-off from the truck engine located under the hood in the cab 11, or by belts and pulleys, or by gears, or by chains and sprockets, or by another means. The pump 79 is connected by means of a hose 80 to a second port 81 on top of the tank 17. The pump 79 removes only air from the sealed tank 17 so that liquids or solids never pass through the pump. If desired, a check valve may be included in the line comprising the hose 80 to prevent liquids from entering the vacuum pump 79.

The debris holding tank 17 may be provided with a discharge hose 83 (FIG. 2) through which liquids may be discharged from the tank. The discharge hose 83 extends from the closed side 60 of the tank 17. The liquid in the tank 17 may be separated from the solid debris therein by means of a float valve, such as that shown in copending U.S. patent application Ser. No. 876,900, which is connected to the end of the hose 83 inside the tank. Positive pressure may then be provided in the tank by known reversing flow means associated with and connected to the vacuum pump 79 so that the effect of the pump is reversed and positive pressure is supplied to the tank through the connecting hose 80 to force the liquids in the tank out the discharge hose 83, while the valve 69 located at the top of the vertical tube 65 (FIG. 1) is closed to prevent the pressure from being lost through the conduit 68. Suitable pump reversing flow means are found in copending U.S. patent application Ser. No. 876,900.

The tank 17 may also include one or more sight glasses 85 for indicating the level of debris in the tank. These sight glasses are preferably provided on the closed side 60 of the tank.

Figure 3:
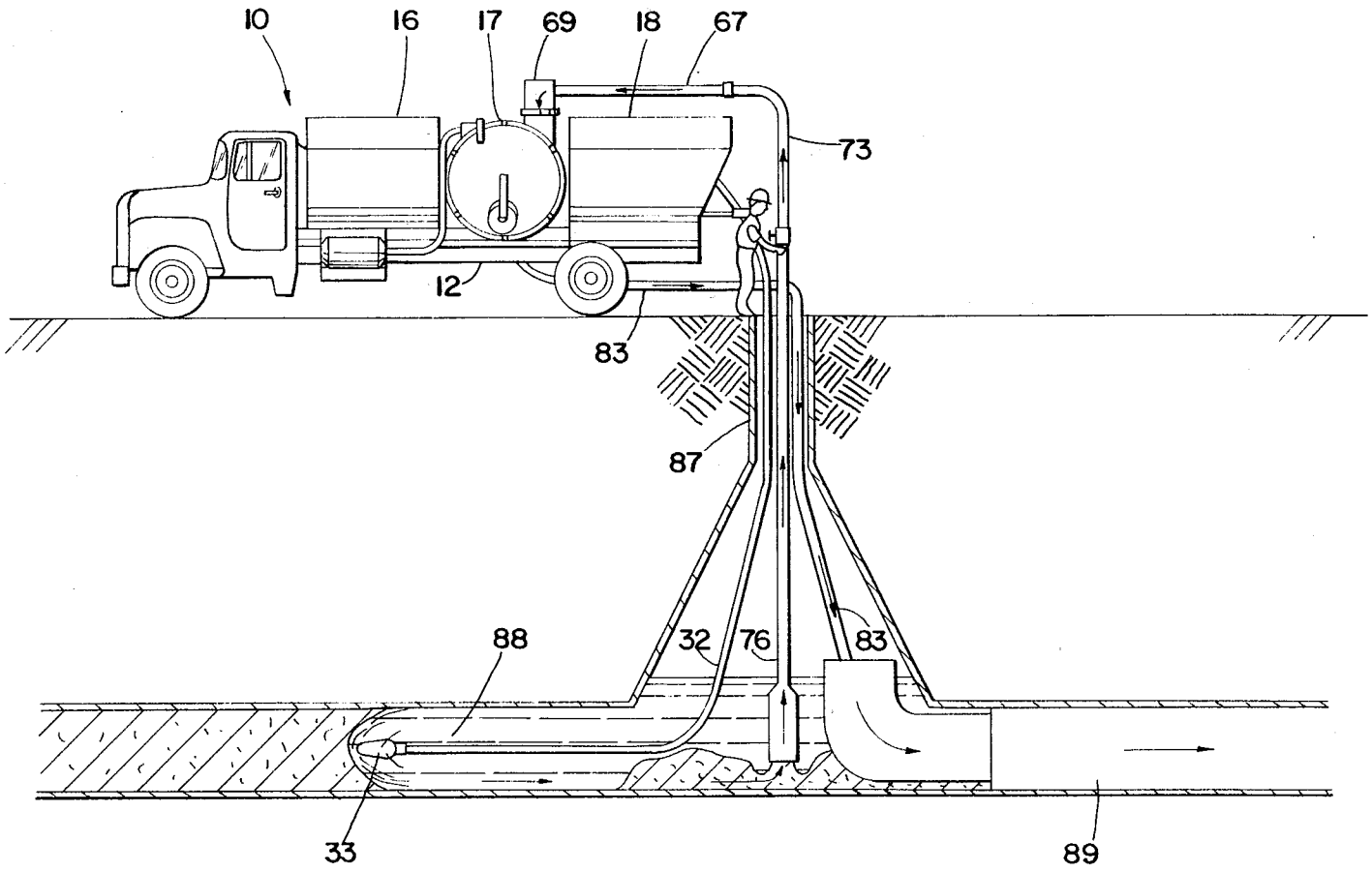
FIG. 3 is a side elevational view, similar to FIG. 1 but to a smaller scale, showing the unit in the operation of cleaning a sewer.

In the operation of the sewer cleaning unit of the present invention, the truck 10 may be driven over streets or roads to the desired point of operation. The truck 10 is then positioned with the manhole 87 or other opening to a chamber directly behind the vehicle, as shown in FIG. 3. The levers 38 and 39 (FIG. 2) are then operated to pay out the hose 32 from the hose reel 31, so that the hose extends down into the manhold 87 (FIG. 3). The flexible conduit 68 is extended downwardly and the intake tube 76 is placed into the manhole 87. The end of the intake tube 76 is preferably completely submerged; it removes liquid and solid debris at the same time. The levers 47 and 48 (FIG. 2) are then actuated to permit the pump 29 to begin supplying water to the hose 32. The self-propelling nozzle 33 on the leading end of the hose 32 feeds the hose through the sewer pipe 88 or other conduit to be cleaned as the hose unreels from the reel 31. The operator then actuates the control of the vacuum pump 79 (FIG. 1) to create a partial vacuum in the debris holding tank 17. With the valve 69 open, suction is created at the mouth of the intake tube 76 so that water and debris forced backwardly by the flow of water from the nozzle 33 are sucked out of the chamber through the conduit 68 and into the tank 17.

When the tank 17 becomes filled, the valve 69 may be closed and the effect of the pump 79 may be reversed to create positive pressure in the tank 17 to force liquid from the tank 17 through the discharge hose 83 (FIG. 3) and into the downstream sewer line 89.

When the tank 17 becomes filled with solid debris and sludge, it can be emptied by opening the latches 63 to open the head 61 or other means on the side of the tank and tilting the tank upwardly on one side to discharge debris from the tank or cleaning the tank by other known means without tilting the tank.

The placement of the debris holding tank 17 on the truck frame 12 between the water reservoir tank 16 and the water handling components assembly unit 18 permits an even weight distribution on the vehicle, which allows the entire unit to be mounted on a conventional truck frame with a single rear axle rather than tandem axles, without a major reduction in the size of one or both tanks which would reduce the capablities of the unit. If the debris holding tank were mounted on the forward end of the truck frame directly behind the cab and in front of the water reservoir tank, the weight distribution would be such that it might not be possible to use a single rear axle, and a tandem axle would be necessary. The additional weight of the debris holding tank and the longer boom mounted on the tank would result in increased weight loads on the front axle of the vehicle, and the remedy to this front axle overload would be to shift the components rearwardly, thereby drastically increasing the weight load on the rear axle and making a tandem rear axle necessary.

While the preferred form of this invention has been specifically illustrated and described herein, it will be apparent to those skilled in the art that modifications and improvements may be made to the form herein specifically disclosed. Accordingly, the present invention is not to be limited to the form herein specifically disclosed or in any other way inconsistent with the progress in the art promoted by this invention.

What is claimed is:

1. Apparatus for cleaning a chamber which comprises:

a wheeled vehicle having a frame supported by a front wheel axle and a single rear wheel axle;

a water reservoir tank mounted near the front of the vehicle frame, said water reservoir tank adapted to hold a supply of water and having a capacity of at least 500 gallons;

a hose unit mounted at the rear of said vehicle frame, said hose unit having a hose connected to said water reservoir tank and adapted to be inserted into the chamber to discharge water thereinto;

a debris holding tank mounted on said vehicle frame horizontally separated from said water reservoir tank between said water reservoir tank and said hose unit, said debris holding tank adapted to receive and hold debris and having a capacity of at least 500 gallons; and a boom mounted on top of said debris holding tank and adapted to extend rearwardly over said hose unit, said boom having a conduit connected to said debris holding tank and adapted to be lowered into the chamber to be cleaned to transport material from the chamber into said debris holding tank.

2. Apparatus for cleaning a chamber as in claim 1, comprising in addition means for creating a partial vacuum in said debris holding tank to suck debris through said conduit and into said debris holding tank.

3. Apparatus for cleaning a chamber as in claim 1 or 2, comprsing in addition means for pumping water from said water reservoir tank to said hose.

4. Apparatus for cleaning a chamber as in claim 1 or 2, wherein said debris holding tank has means on one side adapted to be opened to discharge debris therefrom.

5. Apparatus for cleaning a chamber as in claim 1, comprising in addition a discharge hose connected to said debris holding tank to permit debris from said debris holdng tank to be discharged therefrom.

6. Apparatus for cleaning a chamber as in claim 5, comprising in addition means connected to said debris holding tank for creating positive pressure in said tank to force debris out of said tank through said discharge hose.

7. Apparatus for cleaning a chamber as in claim 6, comprising in addition a valve at the connection between said conduit and said debris holding tank to close said conduit when positive pressure is created in said debris holding tank to prevent pressure from being lost through said conduit.

8. Apparatus for cleaning a chamber which comprises:

a truck having a forward cab and a rear frame supported by a front wheel axle and a single rear wheel axle;

a water reservoir tank mounted near the front of the vehicle frame, the water reservoir tank adapted to carry a supply of water and having a capacity of at least 500 gallons;

a hose reel assembly mounted at the rear of the vehice frame, said reel assembly having a reel with a hose connected to said water reservoir tank, said hose adapted to be inserted into the chamber to discharge water thereinto;

water pump means connected between said water tank and said hose reel assembly to supply water to said hose at high pressures;

a debris holding vacuum tank mounted on said frame between said water reservoir tank and said hose reel assembly, said vacuum tank adapted to receive and hold debris and having a capacity of at least 500 gallons, said vacuum tank having means on one side adapted to be opened to discharge debris therefrom;

a boom mounted on top of said vacuum tank and adapted to extend rearwardly over said hose reel assembly, said boom having a conduit connected to said vacuum tank and adapted to be lowered into the chamber to be cleaned;

a discharge hose connected to said vacuum tank and adapted to permit debris in said vacuum tank to be discharged therefrom; and vacuum pump means for creating suction in said vacuum tank to suck debris from the chamber into said vacuum tank through said conduit, and for creating positive pressure in said vacuum tank to discharge material from said tank through said discharge hose.

9. Apparatus for cleaning a chamber as in claim 1, wherein said water reservoir tank and said debris holding tank each have a capacity of from 800 to 1,500 gallons.

* * * * *

UNITED STATES PATENT AND TRADEMARK OFFICE

CERTIFICATE OF CORRECTION

PATENT NO. : 4,234,980

DATED : November 25, 1980

INVENTOR(S) : Angelo DiVito and Benjamin P. Fisco, Jr.

It is certified that error appears in the above—identified patent and that said Letters Patent is hereby corrected as shown below:

Column 1, line 56, delete "system" and insert --stream--.

Column 8, line 35, delete "holdng" and insert --holding--.

Column 8, line 56, delete "vehice" and insert --vehicle--.

Signed and Sealed this

*Seventh* Day of *April 1981*

[SEAL]

*Attest:*

RENE D. TEGTMEYER

*Attesting Officer*

*Acting Commissioner of Patents and Trademarks*